US005149058A

United States Patent [19]

Nishimura

[11] Patent Number: 5,149,058

[45] Date of Patent: Sep. 22, 1992

[54] LEVER-OPERATED HOIST

[75] Inventor: Yosaku Nishimura, Osaka Prefecture, Japan

[73] Assignee: Vital Kogyo Kabushiki Kaisha, Osaka, Japan

[21] Appl. No.: 615,847

[22] Filed: Nov. 20, 1990

[30] Foreign Application Priority Data

Dec. 20, 1989 [JP] Japan ..... 1-147434[U]

[51] Int. Cl.[5] ..... B66D 1/04

[52] U.S. Cl. ..... 254/369; 254/352; 254/372

[58] Field of Search ..... 254/352, 353, 357, 346, 254/369, 372; 112/279

[56] References Cited

U.S. PATENT DOCUMENTS

| | | | |
|---|---|---|---|
| 3,047,114 | 7/1962 | Stevens | 254/352 |
| 4,469,308 | 9/1984 | Nakamura | 254/352 |
| 4,471,946 | 9/1984 | Maeda | 254/353 |

*Primary Examiner*—Katherine Matecki

*Attorney, Agent, or Firm*—Mason, Fenwick & Lawrence

[57] ABSTRACT

A lever-operated hoist with an operation lever support structure capable of operating smoothly, especially in the horizontal position. The operation lever has an inner tubular part which is slidably and rotatably supported in or on the a tubular part of the brake cover. A tubular assembly member is radially inward of the innermost of these tubular parts and has flanges at the ends to arrest and hold the tubular parts against movement in the axial direction of a drive shaft of the hoist.

6 Claims, 6 Drawing Sheets 11
1
1b
23
1a
22
16
21
26
24a
25a
30c
24
30b
27
18a
14b
7
18
30a
4a
4b
10
7
30
20
2a
19
4
28b
2
17
14a
14
5
24b
13
28
30b
28a
15
26a
9
3
31
32
21a
25
6
33

LEVER-OPERATED HOIST

BACKGROUND OF THE INVENTION

1. Field of the Invention

The present invention relates to a lever-operated hoist for hoisting up or hoisting down by repeatedly turning an operation lever, and more particularly to a lever-operated hoist with an operation lever support structure for smoothly idling in the horizontal state.

2. Description of the Prior Art

A general support structure of an operation lever in a conventional lever-operated hoist is shown in FIG. 7, in which a cover part b of an operation lever a comprises an inside tubular part c, a brake cover e attached to a side plate d of the hoist main body comprises a tubular part f, and the inside tubular part c of the operation lever a is rotatably supported on this tubular part f. The tubular parts c, f are parallel to the axial line of a drive shaft g. In addition, h is a driven wheel, i is a friction plate, j is a brake release spring, k is a driving wheel, and l is a manual operation wheel.

In such support structure, however, since its support surface, that is, the outside surface of the tubular parts c, f is a tubular surface parallel to the axis of the drive shaft g, the support surface can bear the load only in the radial direction. Also, in order to maintain smooth rotary movements of these support surfaces, the diameters of the two support surfaces a different, providing a slight gap between them. Accordingly, the operation lever a is likely to produce an excessive play not only in its original rotating direction (the rotating direction of the drive shaft g), but also in the axial direction of the driving shaft g, and consequently a stable support state is not obtained. As a result, when operating the hoist, the inside tubular part c of the operation lever a often contacts the driving wheel k, or the outside tubular part m at the opposite side of the tubular part c is likely to contact the driving wheel k or manual operation wheel l, and the operation of the hoist is not smooth.

In other words, while idling, that is, in a no-load state without suspending a load, when the manual operation wheel l is operated and the lower hook of the load chain (not shown) is pulled to return the load chain to the specified length, if such contact as mentioned above occurs, the rotating force of the driving parts such as the driven wheel h, driving wheel k and manual operation wheel l mounted on the drive shaft g is increased, and it is not rotated smoothly. Such event is particularly evident when using the hoist in the horizontal state.

In this regard, a support structure as shown in FIG. 8 was proposed. In detail, the inside tubular part c of the operation lever a and the tubular part f of the brake cover e are arcuate, and these tubular parts c, f are fitted so as to be rotatable and not to move in the axial direction of the drive shaft g (for example, Japanese Patent Publication No. 59-163298, Japanese Utility Model Disclosure No. 58-99289 and Japanese Utility Model Publication No. 62-18625).

However, if the tubular parts c, f are arcuate high precision is required in the machining of these fitting parts in order to maintain with precision the assembly of the operation lever a to the brake cover e. As a result, the number of manufacturing steps for the support structure increases, and it takes time and labor in its assembling, and the working efficience becomes poor, and the manufacturing cost is raised.

BRIEF SUMMARY OF THE INVENTION

In the light of the problems of the prior art mentioned so far, it is the primary object of the invention to provide a novel lever-operated hoist which avoids the above noted problems.

It is another object of the invention to provide a lever-operated hoist having an operation lever support structure capable of operating the hoist always smoothly and stably in any operating position and in any condition.

It is other object of the invention to provide a lever-operated hoist having an operation lever support structure in which not only the radial direction load of the operation lever but also its axial direction load are borne by the brake cover, and movement and deflection of the operation lever in the axial direction of the drive shaft are prevented, and a stable support state of the operation lever is obtained.

It is a different object of the invention to provide a lever-operated hoist having an operation lever support structure in which the precision in mounting the operation lever on the brake cover is easily achieved by a small number of manufacturing steps, the efficiency of the assembling work is raised by the decrease of the number of mounting steps and there is a shortening of the assembly time, and hence the manufacturing cost is reduced significantly.

It is a further and different object of the invention to provide a lever-operated hoist with a structure providing the above results without modifying the conventional operation lever support structure at all.

These and other objects of the invention, as well as the features and advantages thereof, will be better understood and appreciated by referring to the following detailed description with the accompanying drawings and in the claims

DETAILED DESCRIPTION OF THE PREFERRED EMBODIMENTS

Figure 1:
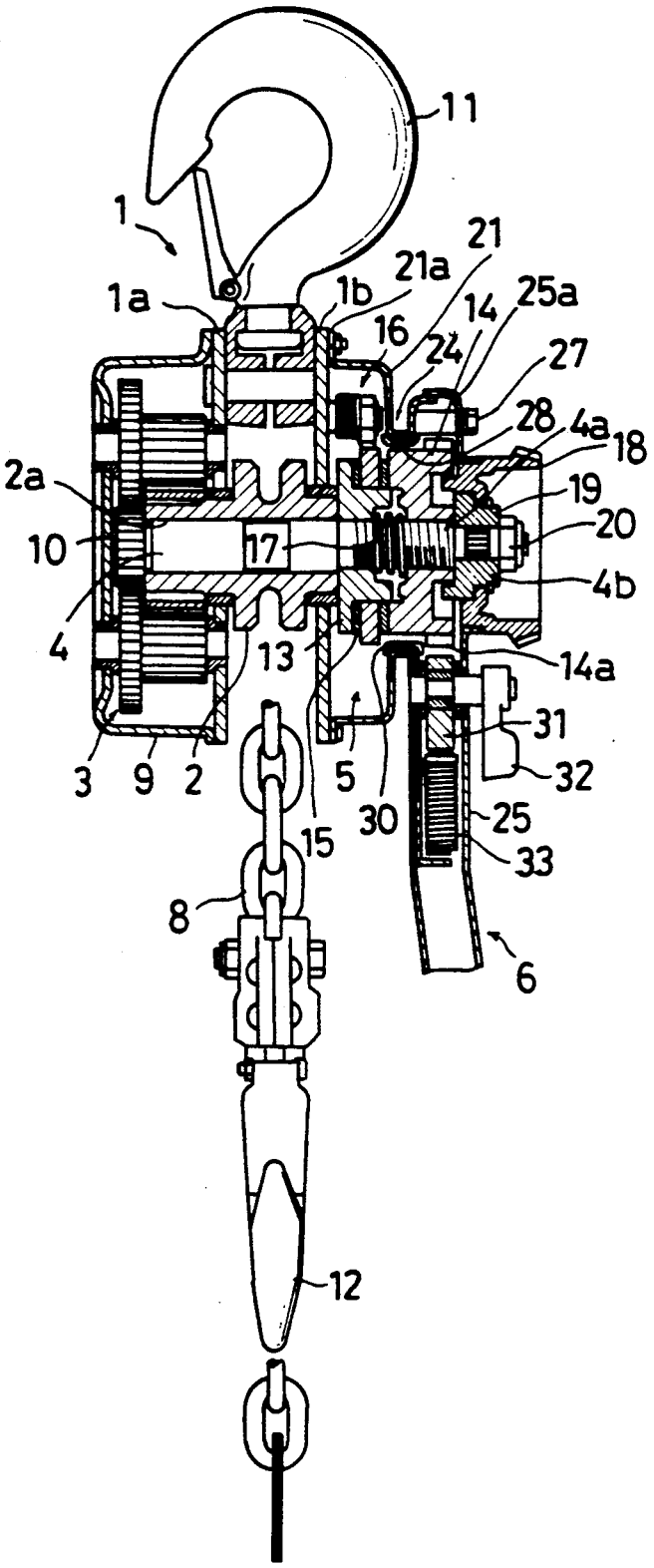
FIG. 1 is a longitudinal sectional view showing a first embodiment of a lever-operated hoist in accordance with the invention.
Figure 2:
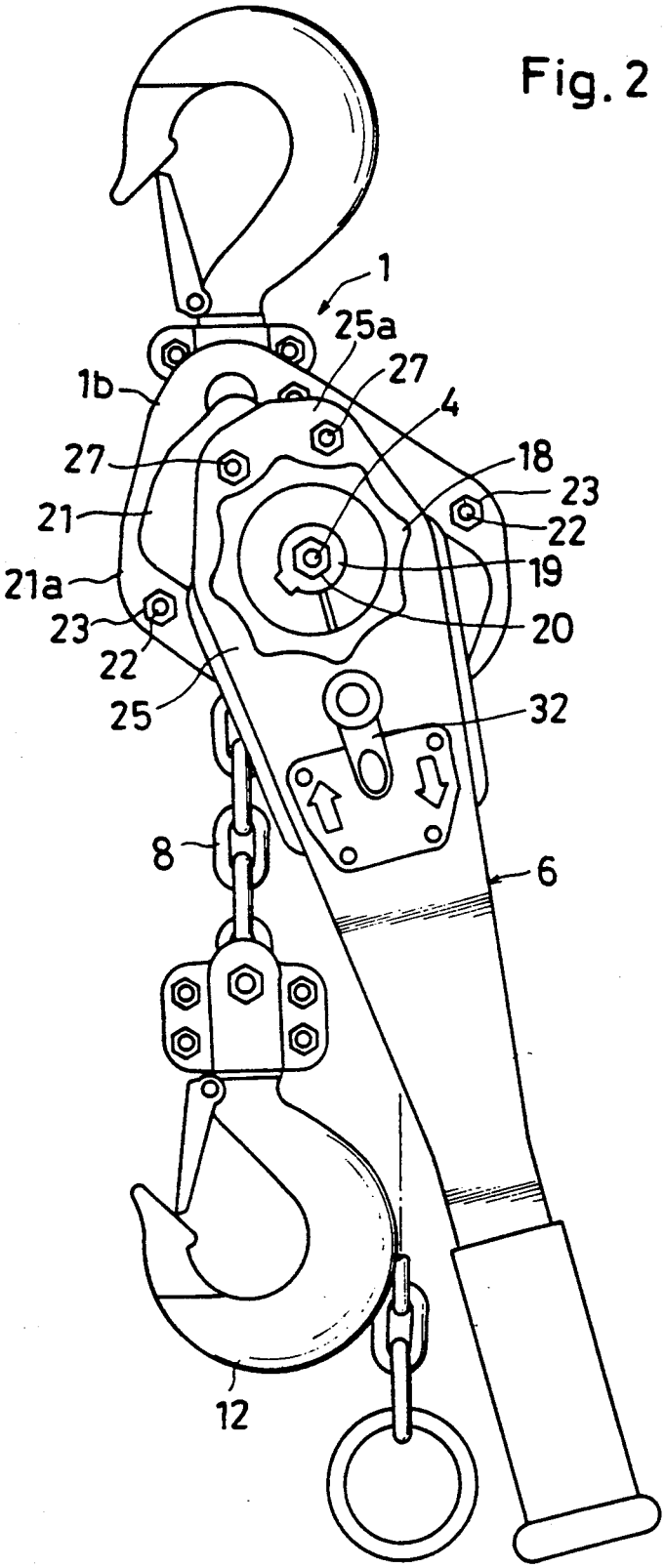
FIG. 2 is a front view thereof.
Figure 3:
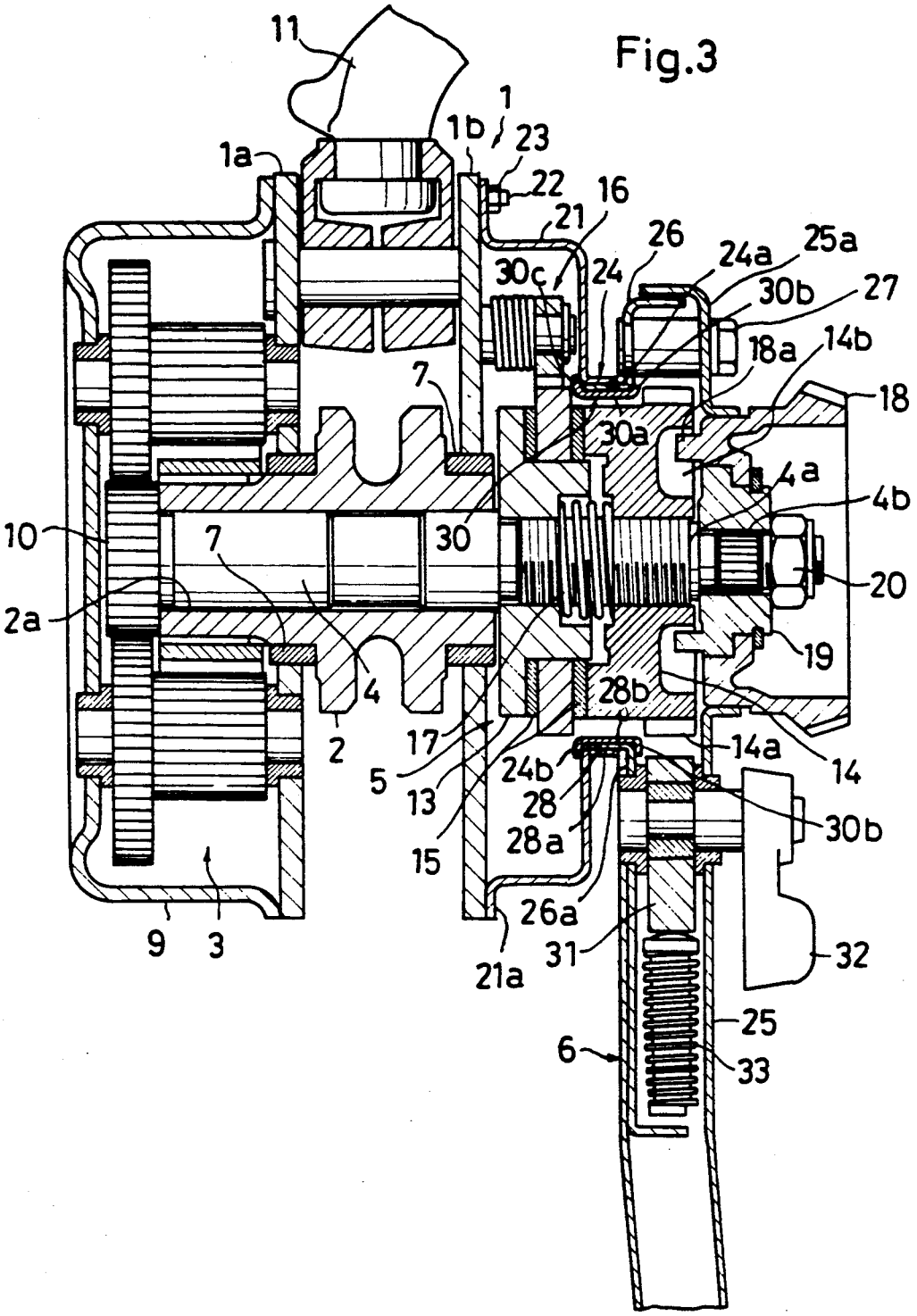
FIG. 3 is an enlarged longitudinal sectional view thereof, with parts broken.

A lever-operated hoist in accordance with a first embodiment of the invention is shown in FIG. 1 through FIG. 3, in which the hoist comprises, as principal components, a hoist main body 1, a load sheave 2, a reduction gear mechanism 3, a drive shaft 4, a drive transmission mechanism 5, and an operation lever 6.

The load sheave 2 is rotatably supported between a pair of side plates 1*a*, 1*b* forming the hoist main body 1 through bearings 7, 7, and a load chain 8 is carried by load sheave 2. The load sheave 2 is connected to a pinion gear 10 of the drive shaft 4, through the reduction gear mechanism 3 composed of plural large and small gears installed in a gear box 9. An upper hook 11 is provided for suspending the hoist main body 1, and a lower hook 12 is provided for suspending the load provided at the lower end of the load chain 8.

The drive shaft 4 is rotatably supported in a shaft hole 2a of the load sheave 2, and the pinion gear 10 is affixed to one end thereof (the left end in the drawing). At the other end of the drive shaft 4 (the right end in the drawing), the drive transmission mechanism 5 is installed, and the drive shaft 5 is connected to the operation lever 5 through this drive transmission mechanism 5.

The drive transmission mechanism 5 has a general known structure, and comprises a driven wheel 13, a driving wheel 14, and a brake unit composed of friction plates 15, 15 and ratchet mechanism 16.

The driving wheel 14 is screwed into a first threaded part 4a of the drive shaft 4 so as to be free to advance or retreat in the axial direction, and a transmission gear 14a is formed on the outer circumference thereof. A coil spring 17 pushes the driving wheel 14 outward in the axial direction (to the right in FIG. 1 and FIG. 3).

Adjacently to the outside in the axial direction of the driving wheel 14, an adjusting member 19 is spline-fitted to a spline part 4b of the driving shaft 4, and a manual operation wheel 18 is rotatably supported on the outer circumference of this adjusting member 19. The manual operation wheel 18 and adjusting member 19 are provided for the purpose of continuous idling motion of the hoist, and the manual operation wheel 18 is used to avoid pressing on the driven wheel 13 by the driving wheel 14 when quickly pulling down the lower hook 12, while the adjusting member 19 is used for preventing the driving wheel 14 from moving excessively outward in the axial direction when quickly pulling up the lower hook 12. A tightening nut 20 is threaded on drive shaft 4, adjacent the adjusting member 19.

The side plate 1b of the hoist main body 1 has attached to it a brake cover 21, and brake parts 15, 16, 15 of the drive transmission mechanism 5 are covered with this brake cover 21.

The brake cover 21 is a steel plate structure, and a mounting flange 21a is provided at the inner end in the axial direction, and it is attached to side plate 1b by a plurality of stay bolts 22, 22, fixed to the side plate 1b and secured by means of nuts 23. At the other end of the brake cover 21, that is, at the outer end in the axial direction, a brake cover tubular part 24 is formed, extending axially. The brake cover tubular part 24 is cylindrical, and its cylindrical inner circumferential surface 24a is concentric with the axis of the drive shaft 4.

The operation lever 6 is intended to rotate and drive the driving wheel 14 in the hoisting-up or hoisting-down direction, and it is rotatably supported on the brake cover 21, its upper part covering the outer circumference of the driving wheel 14.

The operation lever 6 is a steel plate structure, composed of lever main body 25 and a lever cover 26 (FIG. 3). The lever cover 26 is integrally engaged with the upper cover part 25a of the lever main body 25 by means of plural bolts and nuts 27, 27 . . . , thereby covering the entire outer circumference of the driving wheel 14.

At its inner diameter, the lever cover 26 is provided an inside tubular part 28 borne on the brake cover tubular part 24. The inside tubular part 28 cylindrical, and its cylindrical outer circumferential surface 28a is parallel to the axis of the drive shaft 4. The cylindrical outer circumferential surface 28a is slidably and rotatably supported on the cylindrical inner circumferential surface 24a as shown in FIG. 3 and FIG. 4.

Figure 4:
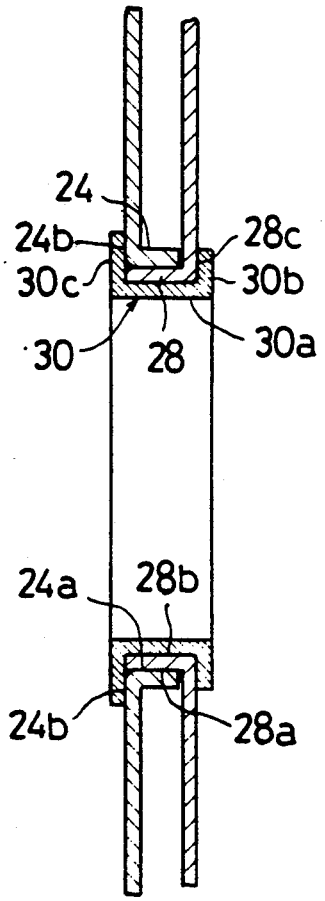
FIG. 4 is an enlarged longitudinal sectional view of the operation lever support structure thereof.

Inside the inside tubular, part 28, a tubular assembly member 30 is inserted, which is a steel plate structure, and is formed as shown in FIG. 4.

More specifically, the tubular assembly member 30 consists of a main body tubular part 30a, and a pair of stopper flanges 30b, 30c disposed at the ends of the main body tubular part 30a. The main body tubular part 30a is cylindrical and is journalled within the cylindrical inner circumferential surface 28b of the inside tubular part 28. The flanges 30b, 30c are bent and formed perpendicularly to tubular part 30a. The inner side of one flange 30b is adjacent outer end part 38c of the inside tubular pat 28, while the other flange part 30c is stopped at the axial direction inner end part 24b of the brake cover tubular part 24, to thereby limit movement of the operation lever 6 in the axial direction. The flanges 30b, 30c may also function as oil seals lubrication grease filling the gap between the cylindrical outer circumferential surface 28a and the cylindrical inner circumferential surface 24a is prevented from leaking out or splashing into the cover of the hoist, particularly into the brake cover 21, and deposits on the friction plates 15, 15 of the brake unit are avoided.

Figure 5:
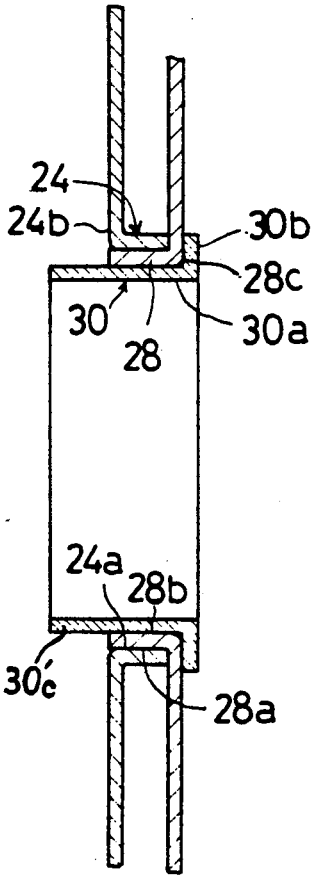
FIG. 5 is an enlarged longitudinal sectional view of the parts shown in FIG. 4 prior to the final manufacturing step.

To produce this support structure for the operation lever 6, in the first place, as shown in FIG. 5, the inside tubular part 28 of the lever cover 26 is inserted into the brake cover tubular part 24 of the brake cover 21 from outside in the axial direction. Then, the flange tubular assembly member 30 is inserted into the inside of the inside tubular part 28 from outside in the axial direction. At this time, the inner surface of the flange 30b is preliminarily bent and engages the outer end part 28c of the inside tubular part 28.

Next, in this state, the inner edge part 30c' of the tubular assembly member 30 is bent at right angle to the outer side to form the flange 30c. At the same time, the inner surface of the flange 30c engages axil direction the axial direction inner end part 24b of the brake cover tubular part 24, thereby completing the support structure as shown in FIG. 4.

Inside the operation lever 6, a rotating direction changeover pawl 31 is provided, and this rotating direction changeover pawl 31 is selectively changed in the engaging configuration position (hoist-up position, hoist-down position, and nonengaged position) with the transmission gear 14a of the driving wheel 14 by manipulating a changeover lever 32 provided on the outside to the operation lever 6. A positioning member 33 for positioning the rotating direction changeover pawl 31 is provided in operating lever 6.

By properly changing over and manipulating the rotating direction changeover pawl 31, when the operation lever 6 is oscillated, the load sheave 2 intermittently rotates in the hoist-up direction or hoist-down direction, so that the lower hook 12 is hoisted up or hoisted down.

Or, when the rotating direction changeover pawl 31 is in the nonengaged position, after manipulating the manual operation wheel 18, by pulling the lower hook 12 down, the lower hook 12 can be lowered quickly, or by pulling down the side of the load chain which is not provided with the lower hook 12, the lower hook 12 can be pulled up quickly.

During these operations, the cylindrical outer circumferential surface 28*a* of the inside tubular part 28 of the operation lever 6 is slidably and rotatably supported on the cylindrical inner circumferential surface 24*a* of the brake cover tubular part 24, and both flanges 30*b*, 30*c* of the tubular assembly member 30 are provided to stop movement in the axial direction of outer end part 28*c* of the inside tubular part 28 and of inner end part 24*b* of the brake cover tubular part 24, and therefore, the radial load of the operation lever 6 is directly borne on the brake cover 21, and its axial load is also borne on the brake cover 21 indirectly through the tubular assembly member 30.

Hence, the operation lever 6 is always kept perpendicular to the axis of the drive shaft 4, and its original motion in the rotating direction (the rotating direction of the drive shaft 4) is smooth, and if moving in the axial direction, deflection and inclination are prevented, and a stable support is maintained.

Figure 6:
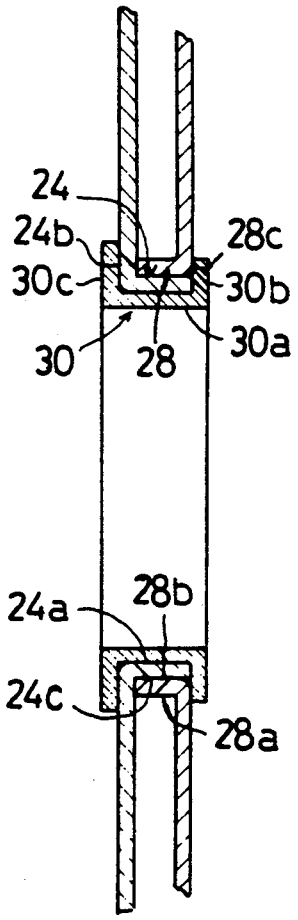
FIG. 6 is an enlarged longitudinal sectional view corresponding to FIG. 4, showing a second embodiment of the operation lever support structure of a lever-operated hoist in accordance with the invention.

In the second embodiment, as shown in FIG. 6, the brake cover tubular part 24 and the inside tubular part 28 of the operation lever 6 is reverse to embodiment 1.

That is, the inner circumferential surface 28*b* of the inside tubular part 28 is slidably and rotatably supported on the outer circumferential surface 24*c* of the brake cover tubular part 24, and the stopper tubular member 30 is inserted into the brake cover tubular part 24, and other structure and the assembling method are the same as in the first embodiment.

Thus, according to the invention, the following excellent effects are brought about.

(1) The inside tubular outer circumference or inner circumference is slidably and rotatably supported on the brake cover tubular inner circumference or outer circumference, and both flanges of the tubular assembly member arrest and hold against movement, the axial direction the outer part of the inside tubular part and the inner part of the brake cover tubular part, and therefore the load in the radial direction of the operation lever is directly borne on the brake cover, and its load in the axial direction is also borne on the brake cover indirectly through the tubular assembly member. As a result, movement and deflection of the operation lever in the axial direction of the drive shaft are prevented, and a stable support for the operation lever is obtained.

Therefore, when manipulating the hoist, contact of the inside of the operation lever with the driving wheel or manual operation wheel due to deflection of the operation lever is avoided. Accordingly, smooth rotation of these driving parts is always maintained, and the hoist may be manipulated always stably in any operating position or in any condition. This effect is particularly evident in the idling operation when using the hoist in the horizontal position.

(2) Both flanges also function as oil seas of the lubricating grease filling the sliding parts between the outer circumferential surface and inner circumferential surface, the grease is prevented from leaking out or splashing into the cover in the hoist, especially in the brake cover, to deposit on the friction plates of the brake unit.

(3) When assembling such operation brake support structural parts, after inserting the inside tubular part of the operation lever into the brake cover tubular part from outside in the axial direction, the tubular assembly member having one flange is inserted into the inside of the tubular part positioned at the inner side of these two tubular parts, and the other flange is then bent and formed.

Therefore, the mounting precision of the operation lever on the brake cover is easily achieved in a small number of steps, and the assembling labor is decreased, the time is shortened, and the assembling work efficiency is raised, and hence the manufacturing cost may be reduced.

Figure 7:
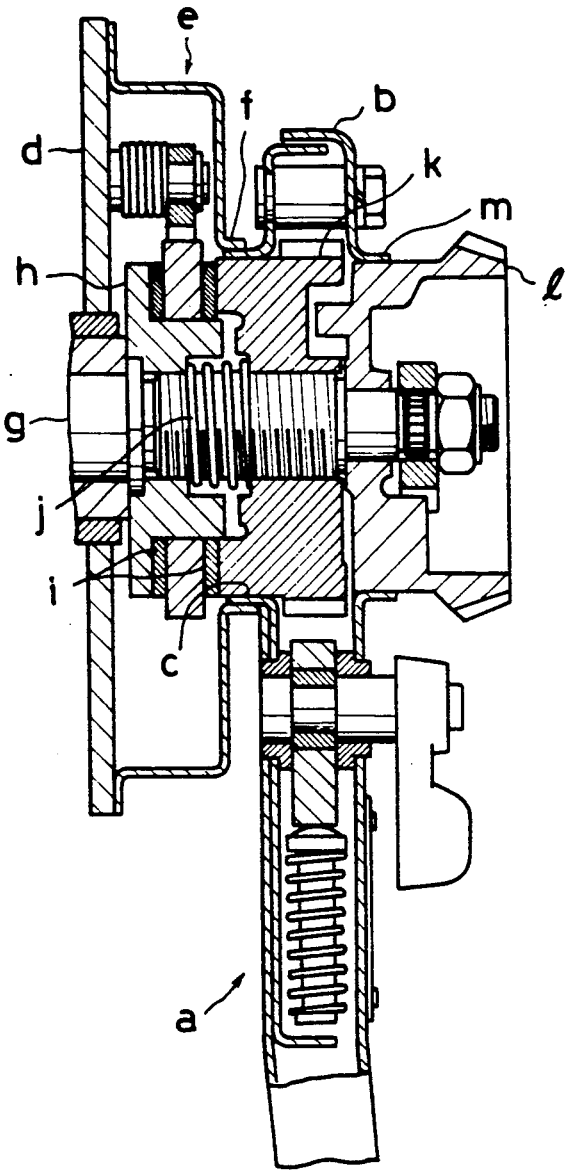
PRIOR ART Fig. 7
FIG. 7 and FIG. 8 show operation lever support structure of conventional lever-operated hoists.
Figure 8:
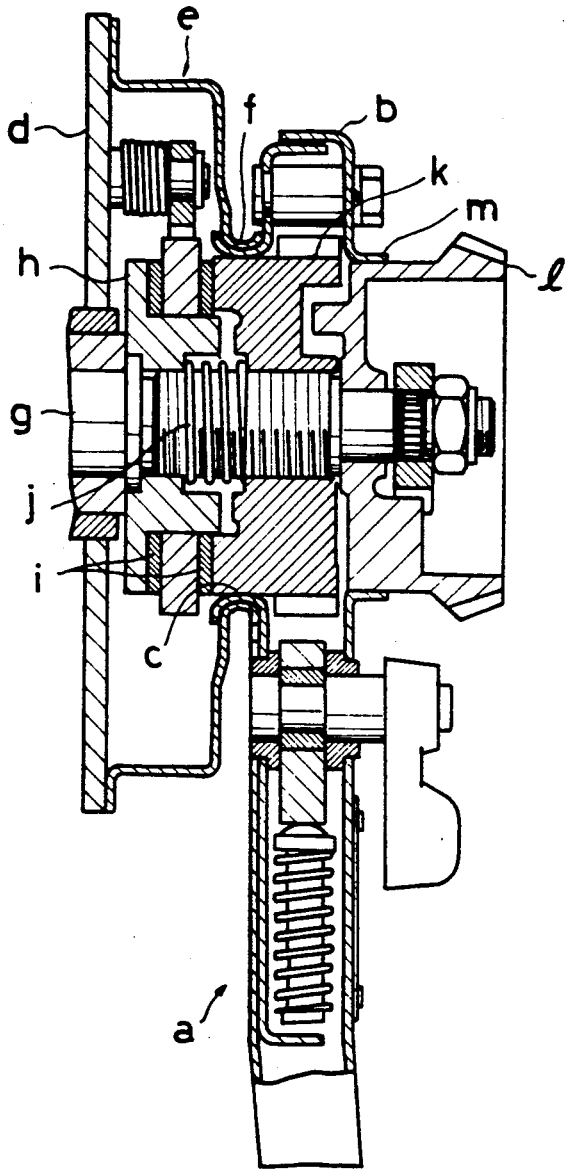

(4) Without any modification of the conventional operation lever support structure shown in FIG. 7, the structure of the invention may be directly utilized, and it is versatile, and in this respect, too, the cost can be reduced.

The foregoing embodiments described in detail herein are intended only to illustrate the technical concept of the invention, and therefore the invention should not be interpreted in a narrow sense by limiting it to these embodiments alone, but should be understood in a wider sense to be modified and changed in various manners without departing from the true spirit and claims of the invention.

What is claimed is:

1. A lever-operated hoist comprising:

a side plate, and a drive shaft transversely thereof, a brake cover attached to the side plate and comprising a tubular part, an operating lever, an operating lever cover thereon comprising an inside tubular part disposed radially inwardly of and journalled in the brake cover tubular part, and a tubular assembly member having a body member mounted radially inwardly of and engaging the inside tubular part, said tubular assembly member having a transverse flange at each end, one of the flanges engaging and holding against movement in the axial direction the inside tubular part, the other flange engaging and holding against movement in the axial direction the brake cover tubular part, thereby limiting the movement of the operation lever in the axial direction of said drive shaft.

2. A lever-operated hoist according to claim 1, wherein the brake cover tubular part comprises a cylindrical inner surface parallel to the axis of the drive shaft, the inside tubular part of the operation lever comprising a cylindrical outer surface parallel to the axis of the drive shaft, and the cylindrical outer surface being slidably and rotatably supported on the cylindrical inner surface.

3. A lever-operated hoist according to claim 2, wherein the body member of said tubular assembly member is cylindrical, and said flanges extend substantially perpendicular to the drive shaft.

4. A lever-operated hoist comprising:

a side plate, and a drive shaft transversely thereof, a brake cover attached to the side plate and comprising a tubular part, an operating lever, an operating lever cover thereon comprising an inside tubular part disposed radially outwardly of and journalled on the brake cover tubular part, and a tubular assembly member having a body member mounted radially inwardly of and against the brake cover tubular part, one of the flanges engaging and holding against movement in the axial direction inside tubular part, the other flange engaging and holding against movement in the axial direction the brake cover tubular part, thereby limiting the movement of the operation lever in the axial direction of said drive shaft.

5. A lever-operated hoist according to claim 4, wherein the brake cover tubular part comprises a cylindrical outer surface parallel to the axis of the drive shaft, the inside tubular part of the operation lever comprising a cylindrical inner surface parallel to the axis of the drive shaft, and the cylindrical inner surface being slidably and rotatably supported on the cylindrical outer surface.

6. A lever-operated hoist according to claim 5, wherein the body member of said tubular assembly member is cylindrical, and said flanges extend substantially perpendicular to the drive shaft.

* * * * *